US011091981B2

(12) United States Patent
Modeland et al.

(10) Patent No.: US 11,091,981 B2
(45) Date of Patent: Aug. 17, 2021

(54) COMPLETION METHODOLOGY FOR UNCONVENTIONAL WELL APPLICATIONS USING MULTIPLE ENTRY SLEEVES AND BIODEGRADABLE DIVERTING AGENTS

(71) Applicant: HALLIBURTON ENERGY SERVICES, INC., Houston, TX (US)

(72) Inventors: Neil Joseph Modeland, Rosenberg, TX (US); Eric Russell Frisbie, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/754,057

(22) PCT Filed: Oct. 14, 2015

(86) PCT No.: PCT/US2015/055600
§ 371 (c)(1),
(2) Date: Feb. 21, 2018

(87) PCT Pub. No.: WO2017/065767
PCT Pub. Date: Apr. 20, 2017

(65) Prior Publication Data

US 2018/0266211 A1 Sep. 20, 2018

(51) Int. Cl.

| | |
|---|---|
| ***E21B 34/10*** | (2006.01) |
| ***E21B 43/26*** | (2006.01) |
| ***E21B 33/13*** | (2006.01) |
| ***E21B 43/14*** | (2006.01) |
| ***E21B 34/14*** | (2006.01) |

(52) U.S. Cl.
CPC ..... *E21B 34/10* (2013.01); *E21B 33/13* (2013.01); *E21B 34/14* (2013.01); *E21B 43/14* (2013.01); *E21B 43/26* (2013.01); *E21B 2200/06* (2020.05)

(58) Field of Classification Search
CPC ..... E21B 34/10; E21B 34/14; E21B 33/13; E21B 43/14; E21B 43/26; E21B 2034/007
USPC ..... 166/308.1
See application file for complete search history.

(56) References Cited

U.S. PATENT DOCUMENTS

| | | | | |
|---|---|---|---|---|
| 7,506,689 | B2 | 5/2009 | Surjaatmadja et al. | |
| 2006/0021753 | A1 | 2/2006 | Wilkinson | |
| 2013/0025860 | A1 | 1/2013 | Robb et al. | |
| 2013/0048282 | A1 | 2/2013 | Adams et al. | |
| 2014/0048271 | A1 | 2/2014 | Coon et al. | |
| 2015/0000922 | A1* | 1/2015 | Harris | E21B 34/14 166/319 |

(Continued)

FOREIGN PATENT DOCUMENTS

| | | |
|---|---|---|
| WO | 2012045165 | 4/2012 |
| WO | 2015041690 | 3/2015 |

OTHER PUBLICATIONS

Rhee, PCT Written Opinion for PCT Application No. PCT/US2015/055600 dated Oct. 14, 2015.

(Continued)

*Primary Examiner* — Matthew R Buck
*Assistant Examiner* — Patrick F Lambe
(74) *Attorney, Agent, or Firm* — Locke Lord LLP

(57) ABSTRACT

A heel-to-toe method and system for horizontal well treatments incorporates use of frac ball and sleeve in conjunction with biodegradable diverting agents.

9 Claims, 5 Drawing Sheets

(56) References Cited

U.S. PATENT DOCUMENTS

| | | | | |
|---|---|---|---|---|
| 2015/0021021 | A1* | 1/2015 | Merron | E21B 34/14<br>166/255.1 |
| 2015/0075797 | A1 | 3/2015 | Jiang et al. | |

OTHER PUBLICATIONS

Rhee, PCT Search Report for PCT Application No. PCT/US2015/055600 dated Oct. 14, 2015.

* cited by examiner

COMPLETION METHODOLOGY FOR UNCONVENTIONAL WELL APPLICATIONS USING MULTIPLE ENTRY SLEEVES AND BIODEGRADABLE DIVERTING AGENTS

BACKGROUND OF THE INVENTION

1. Field of Technology

Unconventional/horizontal wells may be stimulated using plug-and-perf methods and ball-activated frac sleeves methods. These two methodologies are alternatives to one another and each comes with its own costs and benefits.

2. Background of Invention

During either multi-stage plug-and-perf or multi-stage frac sleeve completion methods, reservoir entry points placed in treatment stages in the well may not be fully stimulated and/or uniformly broken down. As a result, the reservoir entry points treated by these methods remain under-stimulated.

BRIEF DESCRIPTION OF THE DRAWINGS

Illustrative embodiments of the present invention are described in detail below with reference to the attached drawing figures, which are incorporated by reference herein and wherein.

The aforementioned illustrative representations in FIGS. 1 through 5 should be understood to be interrelated, and their components, methods of operation, and results may be interchangeable.

DETAILED DESCRIPTION

The following description provides details of particular embodiments of the invention and is not intended to be exhaustive or limited to the invention in the form disclosed. The described embodiments are intended to explain the principles of the invention and the practical application, and to enable others of ordinary skill in the art to understand and practice the claimed invention. Many modifications and variations will be apparent to those of ordinary skill in the art without departing from the scope and spirit of the invention. The scope of the claims may be intended to broadly cover the disclosed embodiments and any such modifications.

As used herein, the singular forms "a", "an" and "the" are intended to include the plural forms as well, unless the context clearly indicates otherwise be. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. The corresponding structures, materials, acts, and equivalents of all means or step plus function elements in the claims below are intended to include any structure, material, or act for performing the function in combination with other claimed elements as specifically claimed.

The disclosed embodiments and additional advantages thereof are best understood by referring to FIGS. 1-5 of the drawings, like numerals being used for like and corresponding parts of the various drawings. Other features and advantages of the disclosed embodiments will be or will become apparent to one of ordinary skill in the art upon examination of the following figures and detailed description. It may be intended that all such additional features and advantages be included within the scope of the disclosed embodiments. Further, the illustrated figures are only exemplary and are not intended to assert or imply any limitation with regard to the environment, architecture, design, or process in which different embodiments may be implemented.

Figure 1:
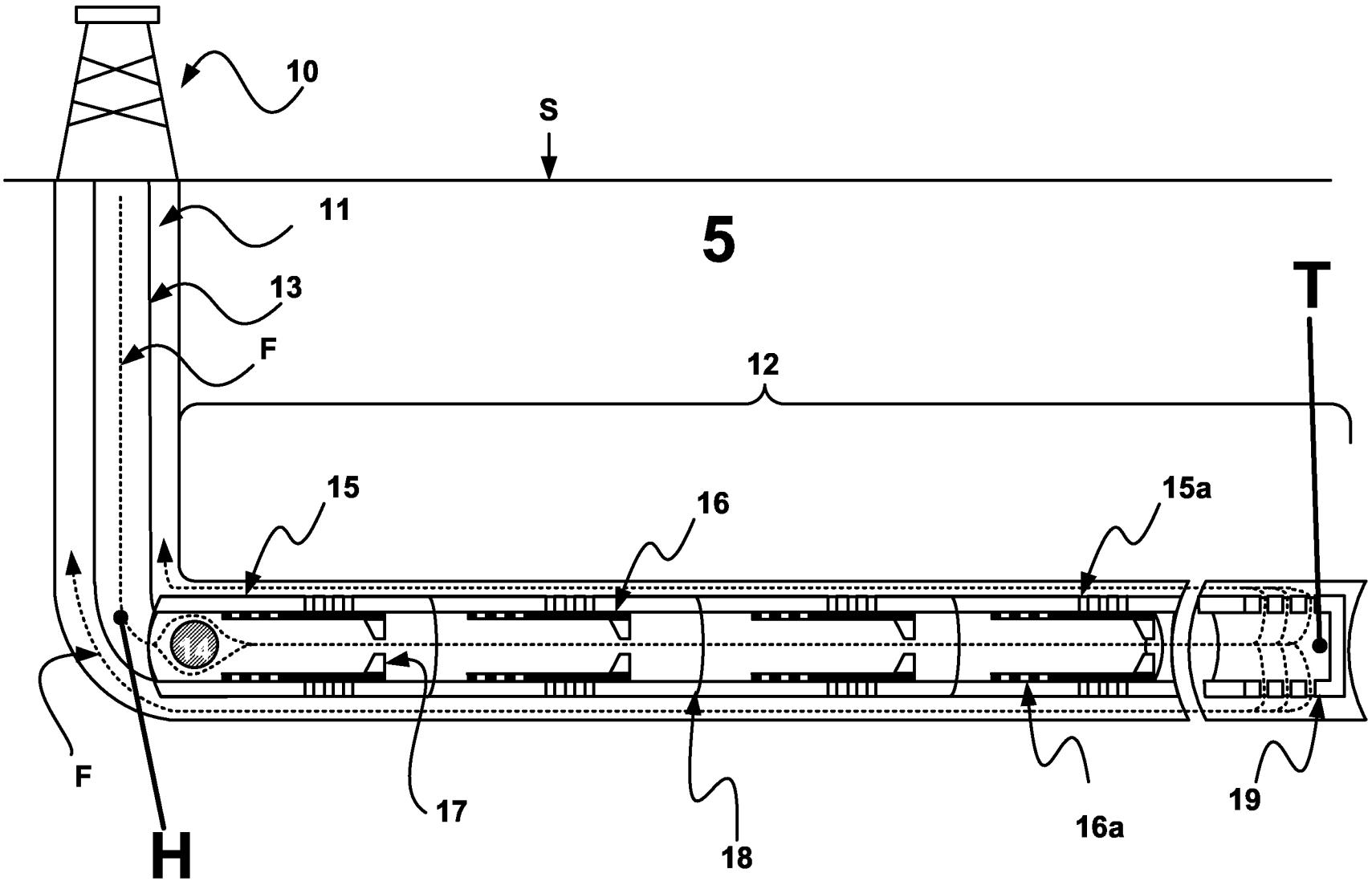
FIG. 1 is a diagram illustrating a horizontal well bore with frac sleeves that are operated using a ball and baffle sliding sleeve method common to one skilled in the art.

In the illustrative embodiment of FIG. 1, an exemplary work site 10 may operate over a production string 11 in a subterranean formation 5 below the surface S. In the production string 11, a string or series of strings 13, which may comprise one or more layers of a composite (e.g., cement), a metal (e.g., steel), conductive casing, and/or casing packers, may be placed to allow for drilling, fracturing, and other well-operations known to those skilled in the art. In a substantially horizontal portion of a well, which may be formed by means and methods known to those skilled in the art, e.g., plug-and-perf type completions, frac sleeve completions, a constructed lateral wellbore section 12 may comprise one or more frac sleeves located through the horizontal well length. The specific area of the well that may be treated is referred to as a "stage" or "zone" in the well. In an exemplary horizontal well, the horizontal well may have a heel "H" and a toe "T" between which multiple frac sleeves may be located to provide entry points to the reservoir. An exemplary frac sleeve may be comprised of a fixed outer housing 15 and an inner shiftable sleeve 16. An exemplary frac sleeve may use a combination of graduated ball and baffle sizes to allow the inner sleeve to shift to an "open" position to allow for fluid to flow out of the wellbore and into the formation. These sliding sleeves can be used in conjunction with the next adjacent frac sleeve to provide a conduit for received fluids, e.g., F, to flow into the reservoir at multiple entry points simultaneously. It should be apparent to one skilled in the art, that this is just one variation of a subterranean oilfield tool that can provide entry points from the inner casing to the reservoir.

For example, in plug-and-perf completion method, a bottom-hole assembly (BHA) consisting of a frac plug and perforating gun(s) may be pumped downhole using wireline deployment methods known to those skilled in the art. The plug may be set using a setting tool that may be activated via electrical signal sent down the wire/e-line. Once set, the BHA may be moved up-hole to the desired location and the perforating gun may be fired to perforate the tubular casing/production. The BHA may be pulled out of hole (POOH) and then a proppant-laden fluid and/or other appropriate treatment fluid, F, may be pumped downhole to fracture and stimulate the formation 5. The fluid may be pumped out the perforations at high rates.

In an exemplary frac sleeve completion method, a fixed outer housing of the frac sleeve 15 may comprise one or more reservoir entry ports 15*a* located about the outer housing of the frac sleeve. In an exemplary embodiment, reservoir entry ports 15*a* may operate as a multiple entry sleeve (MES) for a frac sleeve system in which they are found. Alternatively, an exemplary inner shiftable sleeve 16 may comprise one or more reservoir entry ports 16*a* located about the inner shiftable sleeve 16. In an exemplary embodiment, reservoir entry ports 16*a* may operate as an MES for a frac sleeve in which they are found. In combination the reservoir entry ports 15*a* and 16*a* of the outer housing and inner shiftable sleeves, respectively, may work together to serve as an MES. Those skilled in the art would understand that a multi-entry frac sleeve may be interchanged with a frac sleeve or other comparable subterranean frac tools known to one skilled in the art.

Those skilled in the art would also be familiar with frac sleeve completions, including those which make use of an inner stage sleeve 16 and a baffle 17 for catching and dampening movement of a ball 14. The seating of ball 14 on baffle 17 may restrict the ability of fluid F allow flow 14 throughout the length of the production string 12 by way of obstructing the pathway of the fluid through the baffle 17, by abutting a stop 18, which may be a mechanical construct found on outer stage sleeve 15 or be part of a separate component that interacts with the frac sleeve (e.g., the next adjacent frac sleeve).

Figure 2:
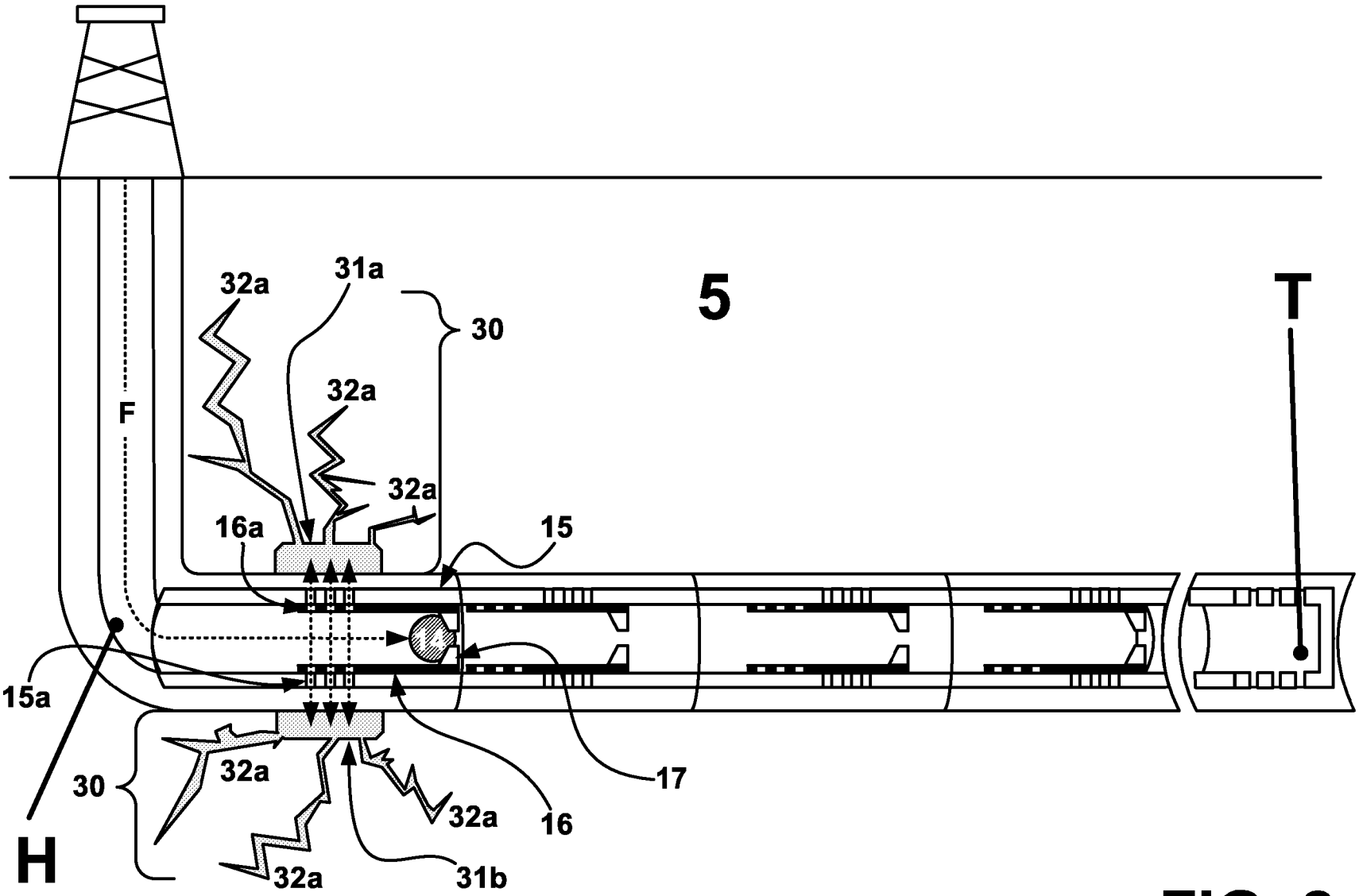
FIG. 2 is a diagram illustrating fracturing of the formation once the reservoir entry ports of the inner sleeve match the reservoir entry ports of the outer sleeve in accordance with disclosed embodiments.

In the illustrative embodiment of FIG. 2, a ball 14 may engage a baffle 17 affixed to the inner sliding sleeve of the frac sleeve 16, thereby sliding the inner sleeve to align the reservoir entry points 16*a* with the reservoir entry points 15*a* of the outer sleeve housing 15. In an exemplary embodiment, alignment of reservoir entry points 16*a* and 15*a* may allow fluid F to pass from the inside of the production casing and into the formation 5 to create fractures 30 having fracture openings 31*a* and 31*b*, and propagation regions 32*a*. In an exemplary embodiment, use of frac sleeve may create numerous fractures 30 about the circumference of the frac sleeve. As illustrated, ball 14 has landed in its position in baffle 17 while fluid F is used to propagate fractures 30 in the formation 5. Ball 14 may not move until baffle 17 yields to the force of fluid F against ball 14. An exemplary baffle 17 may yield in plastic deformation, open in response to pressure changes, or hinge/latch/slide/rotate parts and/or components, or by an alternative mechanical/physical means to allow passage of ball 14 to the next part of the production string.

Figure 3:
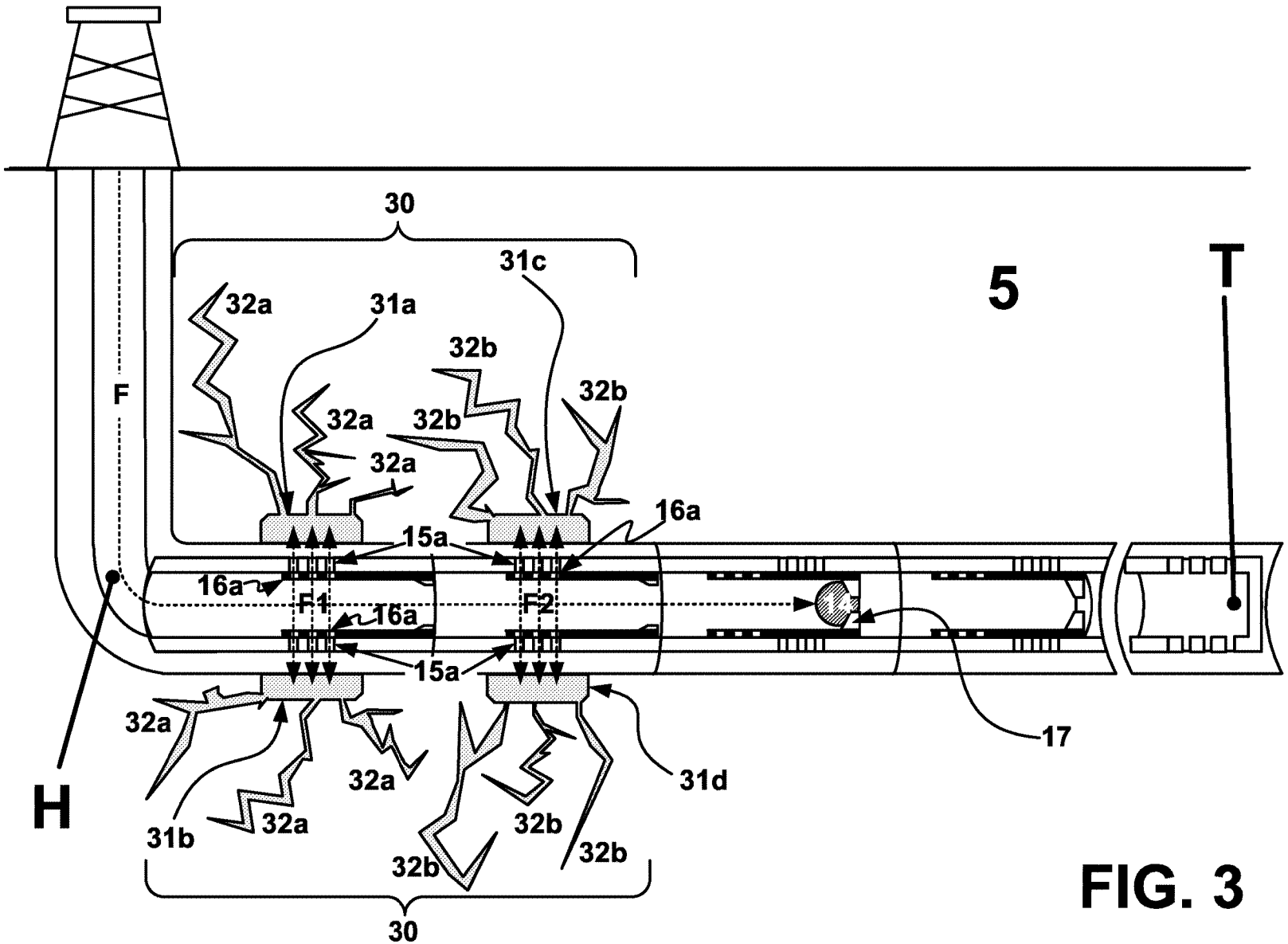
FIG. 3 is a diagram illustrating fracturing of the formation using the alignment of the reservoir entry ports of the inner and outer sleeves in accordance with disclosed embodiments.

In the illustrative embodiment of FIG. 3, ball 14 may be propelled by fluid F past one baffle 17 of an inner sliding sleeve 16 of a frac sleeve and into the next inner sliding sleeve 16 of the adjacent frac sleeve. As ball 14 displaces inner sliding sleeves 16 so that their reservoir entry points 16*a* align with the corresponding reservoir entry points 15*a* of outer sleeve housing 15, fluid F exits there through to create additional fractures 30 in formation 5. Fluid streams F1 may therefore create a fracture 30 having fracture propagations 32*a* while fluid stream F2 may create a fracture 30 having fracture propagations 32*b*. Adjacent the reservoir entry ports 15*a*/16*a* of an exemplary frac sleeve a fracture opening 31*a*, 31*b*, 31*c*, and 31*d* may grow and expand into the formation 5 to allow expulsion of fluids otherwise trapped thereinAs multiple frac sleeves are opened, the ball 14 may stall due to the lack of rate as fluid streams F1 and F2 are primarily flowing into the reservoir. As ball 14 progresses deeper into the horizontal well, the pressure and amount of fluid necessary to cause sufficient stimulation of formation 5 may increase and, therefore, less pressure will be available in the fluid F to cause ball 14 to progress further through the production string 12.

Figure 4:
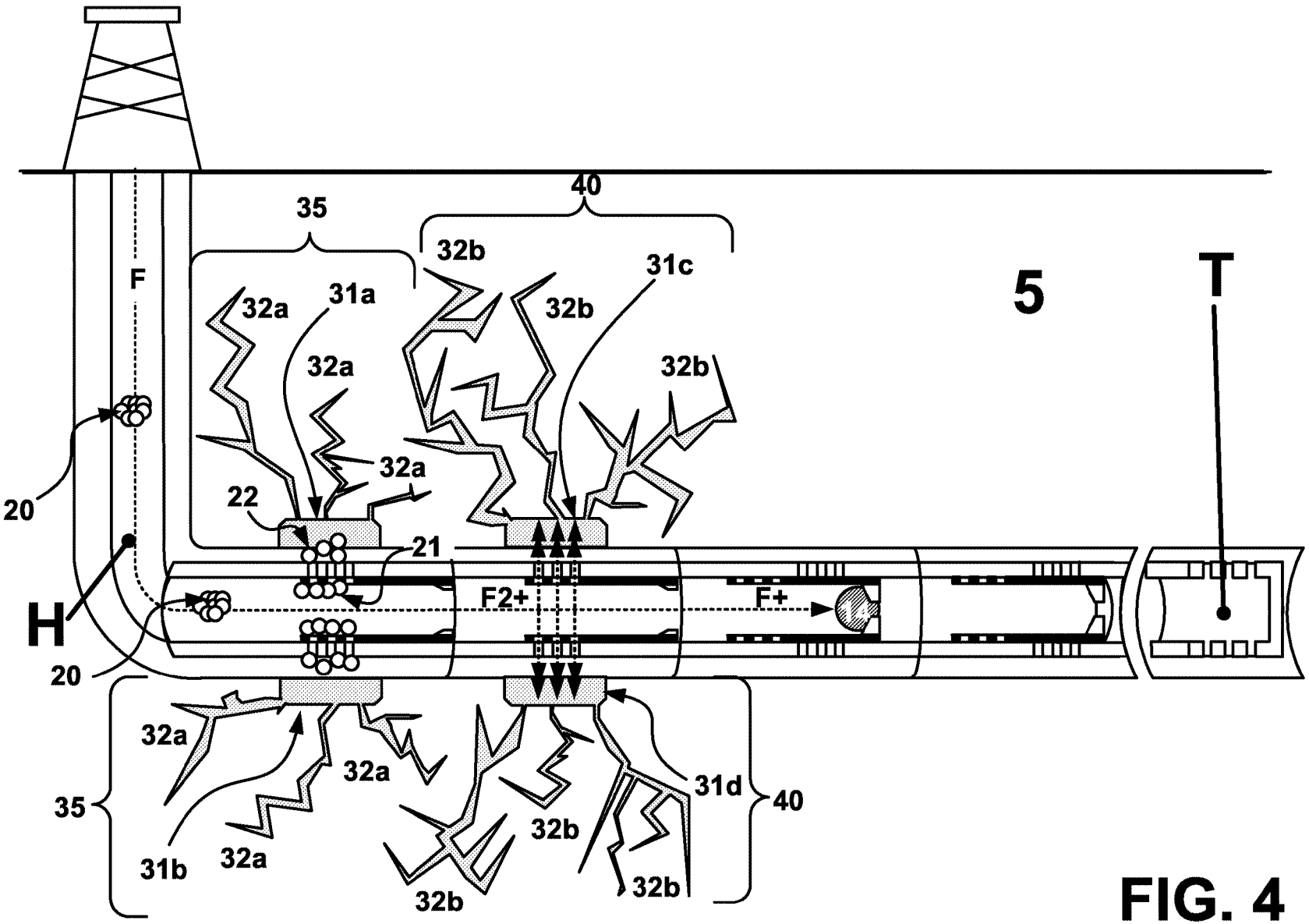
FIG. 4 is a diagram illustrating the use of biodegradable diverting agent in combination with a sliding sleeve arrangement in accordance with disclosed embodiments.
Figure 5:
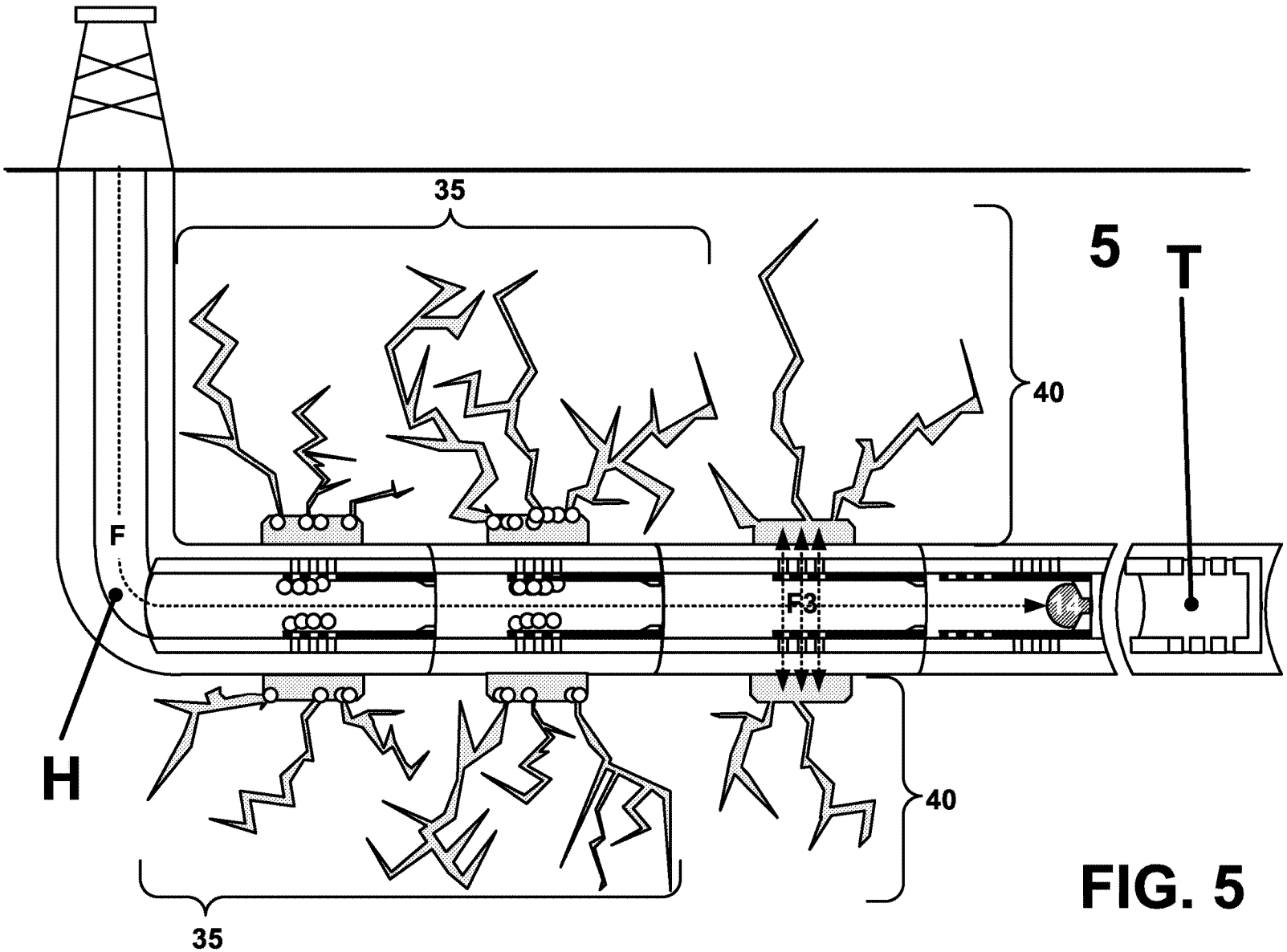
FIG. 5 is a diagram illustrating a system configuration of a frac sleeve and combination of ball and biodegradable diverting agent located in same in accordance with disclosed embodiments.

In the illustrative embodiment of FIG. 4, a biodegradable diverting agent (BDA) 20 may be introduced into the well bore in the stream of fluid F so as to enter into and bridge off flow to the initiated fractures and/or openings in the frac sleeves that are present after the alignment of the reservoir entry ports 15*a* and 16*a* of the outer frac sleeve housing 15 and inner shiftable sleeve 16, respectively. BDA particles 21 may be shown to obstruct the inner stage sleeve 16 at reservoir entry ports 16*a*. Alternatively or additionally, BDA particles 22 may obstruct the entry ports 15*a* of outer stage sleeve 15. Alternatively or additionally, BDA particles 22 may also obstruct fluid F passage into fracture opening 31*a*. In an exemplary embodiment, BDA may be flowed into the openings with the fluid treatment flow into the fracture, where it is compacted and held in place by the differential pressure that exists between the wellbore and the reservoir and fracture. The BDA is of any type known to those skilled in the art.

As further illustrated in FIG. 4, BDA may be used to close off fluid F passage to a substantially empty fracture 35, e.g., a fracture that is completely or substantially stimulated. By limiting points of egress for fluid F, BDA prevents loss of pressure in the fluid F to these regions, thereby allowing for increased pressure flows, F2+, at adjacent fractures 40, or increased pressures on ball 14, flow F+. Adjacent fractures 40 may grow as compared to their preexisting state, e.g., as a fracture 30, due to higher pressure fluid, e.g., F2+, at the fracture entry 31*c*. By using BDA as described, the frac sleeve may further stimulate already existing fractures in the formation 5, or, as may be illustrated in FIG. 5, stimulate new fractures further downstream (see fluid stream F3 stimulating new fracture 40). Thus, the use of BDA in combination with frac sleeves as illustrated may result in increased and/or substantially complete fracture propagation and well treatment while ensuring ball 14 does not stall in response to losses in rate into the formation 5.

The disclosed treatment methodology may allow for increased number of frac sleeves used in a horizontal well due to the fact that a single ball could be utilized for each sleeve while using a BDA to keep the ball from stalling as the ball is pumped through the sleeves. Once a frac sleeve would be installed in the casing/production string as designed, one ball and baffle size may be used throughout the entire length of the wellbore.

In accordance with disclosed embodiments, a well may be treated heel-to-toe instead of the traditional toe-to-heel. Ball 14 may be dropped from surface S and pumped down to activate the first frac sleeves in the wellbore 11. As the frac sleeves are opened, the flowrate pumping the ball 14 down will decrease due to fluid F being pumped out into the formation 5. Once this occurs, ball 14 will stall. Upon completion of a fracturing treatment sequence, the BDA 20 can be pumped into the well 11. The BDA may serve to more effectively stimulate the wellbore, plug off the treatment ports (e.g., reservoir entry points 15*a*/16*a*, fracture entries 31*a*, 31*b*, 31*c*, 31*d*), and/or allow fluid to continue to push ball 14 downhole to activate subsequent frac sleeves until flowrate F diminishes and ball 14 stalls again. This process may be repeated until the entire wellbore has been stimulated and all of the frac sleeves have been opened. Once all frac sleeves have been opened, and since only one baffle and ball size may be used, the wellbore may not require coiled tubing to mill out baffles of descending sizes. Additionally and alternatively, utilizing a dissolvable ball 14 may allow for a completely intervention-less completion method.

While the disclosed embodiments may be amenable to being used as a one-ball-and-baffle frac sleeve/heel-to-toe type of application, it is also contemplated that the disclosed embodiments may be used to break the wellbore into large segments of the same ball/baffle sleeve and treated in a more traditional toe-to-heel method. For example, a plurality of horizontal well portions may be divided and completed using sets of frac sleeves, that utilize the aforementioned ball and baffle system. For example, a horizontal portion of a well may be 8,000 ft, which may be broken into four 2,000 ft. segments. A first 2000 ft. segment may be the portion at the toe of the well and may have the smallest ball and baffle combination of the four segments (although, the baffle inner diameter (ID) may still be a large baffle ID to minimize wellbore restrictions). In accordance with the disclosed embodiments, the first 2000 ft. segment may be completed using the MES/BDA methodology to activate all of the sleeves located in that segment of the well. Once that segment was completed, a different size ball and baffle sleeve could be used to stimulate the next 2,000 ft. segment of the horizontal well in the same manner.

A method for completion of a horizontal well in a subterranean formation, the horizontal well having a heel and a toe, may comprise the steps of: pumping fluid into a first frac sleeve proximal to the heel of the horizontal well, pumping fluid through at least one opening in the first frac sleeve into contact with the formation, providing a BDA to interact with the at least one opening in the first frac sleeve, restricting the fluid from flowing into the at least one opening in the first frac sleeve after the BDA interacts with the at least one opening in the first frac sleeve, and pumping fluid into a second frac sleeve more proximal to the toe of the horizontal well than the first frac sleeve. Such a method may further include fracturing the formation in a second stage located distal to the heel and proximal to the toe of the horizontal well, and pumping fluid into a second frac sleeve more proximal to the toe of the horizontal well than the first frac sleeve, pumping fluid against a ball traversing the inside of the second frac sleeve, pumping fluid against a ball to permit fluid through the at least one opening into contact with the formation, and pumping fluid into a second frac sleeve more proximal to the toe of the horizontal well than the first frac sleeve, and/or propelling a ball disposed within the first frac sleeve that is stalled following a fracture in the formation adjacent the at least one opening in the first frac sleeve. Alternatively and additionally, where a ball disposed within the first frac sleeve stalls following a fracture in the formation adjacent the at least one opening in the first frac sleeve, the ball may be pumped through the second frac sleeve after the BDA interacts with the at least one opening in the first frac sleeve.

In any of the foregoing methods, the first frac sleeve may be directly or indirectly coupled to the second frac sleeve, one of the first frac sleeve and the second frac sleeve is an MES, and/or both the first frac sleeve and second frac sleeve is an MES.

A system for horizontal well completion comprises: a plurality of frac sleeves arranged in a horizontal well, the horizontal well having a heel and a toe and being located in a subterranean formation, a BDA disposed on at least one of the plurality of frac sleeves at a location more proximal to the heel of the horizontal well and disposed proximal to a fracture in the formation, and a ball disposed within at least one of the plurality of frac sleeves and separating the BDA from the terminal portion of the horizontal well.

A system for horizontal well completion that comprises: a plurality of frac sleeves arranged in a horizontal well, the horizontal well having a heel and a toe and being located in a subterranean formation, a BDA disposed on at least one of the plurality of frac sleeves at a location more proximal to the heel of the horizontal well and disposed proximal to a fracture in the formation, and a ball disposed within at least one of the plurality of frac sleeves and separating the BDA from the terminal portion of the horizontal well, may also comprise at least one of the plurality of frac sleeves being a multiple entry sleeve, each of the plurality of frac sleeves being a multiple entry sleeve, a dissolvable ball, and/or each of the plurality of frac sleeves have substantially the same inner diameter.

A system for horizontal well completion that comprises: a plurality of frac sleeves arranged in a horizontal well, the horizontal well having a heel and a toe and being located in a subterranean formation, a BDA disposed on at least one of the plurality of frac sleeves at a location more proximal to the heel of the horizontal well and disposed proximal to a fracture in the formation, and a ball disposed within at least one of the plurality of frac sleeves and separating the BDA from the terminal portion of the horizontal well, may also comprise at least one of the plurality of frac sleeves being a multiple entry sleeve, each of the plurality of frac sleeves being a multiple entry sleeve, a dissolvable ball, and/or each of the plurality of frac sleeves have substantially the same inner diameter. Such a system may also comprise a substantially completed fracture proximal to the BDA, a further fracture in the formation distal to the location of the BDA and proximal to and before the ball that may be substantially completed.

The above detailed description may be of a small number of embodiments for implementing the invention and may be not intended to limit the scope of the following claims.

The invention claimed is:

1. A method for completion of a horizontal well in a subterranean formation, the horizontal well having a heel and a toe, the method comprising the steps of:

pumping fluid into a first frac sleeve proximal to the heel of the horizontal well;

pumping fluid through at least one opening in the first frac sleeve into contact with the formation;

providing a biodegradable diverting agent to interact with the at least one opening in the first frac sleeve;

restricting the fluid from flowing into the at least one opening in the first frac sleeve after the biodegradable diverting agent interacts with the at least one opening in the first frac sleeve;

pumping fluid into a second frac sleeve, the second frac sleeve being an immediately next frac sleeve to the first frac sleeve and more proximal to the toe of the horizontal well than the first frac sleeve; and pumping fluid into a third frac sleeve, the third frac sleeve being an immediately next frac sleeve to the second frac sleeve and more proximal to the toe of the horizontal well than the second frac sleeve, wherein the first frac sleeve is activated first by a ball being disposed therein, the second frac sleeve is activated second by said ball being disposed therein, and the third frac sleeve is activated third by said ball being disposed therein.

2. The method of claim 1, further comprising fracturing the formation in a first stage proximal to the heel and distal to the toe of the horizontal well, and after fracturing the formation in the first stage, fracturing the formation in a second stage located distal to the heel and proximal to the toe of the horizontal well.

3. The method of claim 2, wherein the step of pumping fluid into a second frac sleeve includes pumping fluid against a ball traversing the inside of the second frac sleeve.

4. The method of claim 1, further comprising the step of pumping fluid against a ball to permit fluid through the at least one opening into contact with the formation.

5. The method of claim 1, wherein the ball disposed within the first frac sleeve stalls following a fracture in the formation adjacent the at least one opening in the first frac sleeve.

6. The method of claim 5, wherein the ball is pumped through the second frac sleeve after the biodegradable diverting agent interacts with the at least one opening in the first frac sleeve.

7. The method of claim 6, further comprising fracturing the formation in a first stage proximal to the heel and distal to the toe of the horizontal well, and after fracturing the formation in the first stage, fracturing the formation in a second stage located distal to the heel and proximal to the toe of the horizontal well.

8. The method of claim 1, wherein the first frac sleeve is coupled to the second frac sleeve.

9. The method of claim 1, wherein one of the first frac sleeve and the second frac sleeve is a multiple entry sleeve.

* * * * *